United States Patent [19]

Hed

[11] Patent Number: 4,805,255

[45] Date of Patent: Feb. 21, 1989

[54] COIN-OPERATED VACUUM

[75] Inventor: Virgil C. Hed, Edina, Minn.

[73] Assignee: G.H.C., Inc., St. Louis, Mo.

[21] Appl. No.: 199,209

[22] Filed: May 26, 1988

[51] Int. Cl.[4] ..... A47L 5/38

[52] U.S. Cl. ..... 15/314; 15/339; 15/347

[58] Field of Search ..... 15/314, 339, 327 D, 15/347

[56] References Cited

U.S. PATENT DOCUMENTS

| | | | |
|---|---|---|---|
| 2,051,728 | 8/1936 | Manning | 15/315 X |
| 3,381,327 | 5/1968 | Kelley | 15/314 |
| 3,543,325 | 12/1970 | Hamrick | 15/314 |
| 3,910,781 | 10/1975 | Bryant | 15/314 X |
| 4,194,262 | 3/1980 | Finley et al. | 15/314 |
| 4,202,070 | 5/1980 | Harfst | 15/314 X |
| 4,754,519 | 7/1988 | Duran et al. | 15/314 |

FOREIGN PATENT DOCUMENTS

| | | | |
|---|---|---|---|
| 1062393 | 3/1967 | United Kingdom | 15/314 |

*Primary Examiner*—Chris K. Moore
*Attorney, Agent, or Firm*—Kinney & Lange

[57] ABSTRACT

A coin operated vacuum is made with two housings, one for mounting the coin mechanism and the vacuum motor and blower, and the other comprising the debris collection barrel and filter. The two housings are made so that they are virtually tamper-proof, and are joined together as a unit, with the housing mounting the operating components comprising a tower that is securely fixed from the inside to a support base, and which is constructed to provide ready axis to the internal operating components by removal of a secure draw bolt type lock. The debris collection bin has a removable top which can be removed for access to the interior for removal and replacing of a plastic bag that collects the heavy debris and also for servicing a filter that filters the air on the intake side of the vacuum blower.

7 Claims, 2 Drawing Sheets

COIN-OPERATED VACUUM

BACKGROUND OF THE INVENTION

1. Field of the Invention

The present invention relates to an individually operable and self-contained commercial, coin-operated vacuum.

2. Description of the Prior Art

In the prior art, most service station vacuums and other coin-operated commercial vacuums comprise a single housing that houses the vacuum motor and blower in a cover that is lifted for access to the debris chamber. The cover generally has to be locked in place, and this makes the motor and blower difficult to service, as well as being heavy. Further, the present vacuums are difficult to secure in that they are relatively easily broken into and once broken into, the entire assembly is accessible, including the coin box and the motor and vacuum blower.

SUMMARY OF THE INVENTION

The present invention relates to a coin-operated, self-contained vacuum unit for commercial operation. The unit is made into two separate housings, one of which comprises a tower that houses all of the operating components including the coin box, and which can be made very secure. The tower is also securely mounted on a foundation to anchor it in place. The tower is rigid and has one securely lockable cover. The tower is also securely mounted on a foundation to anchor it in place.

The other unit for the vacuum system is operably connected to the interior of the tower through a vacuum carrying hose that establishes a flow through a filter to create a vacuum in the second housing. The second housing comprises a barrel that has a debris collection bag removably mounted therein. The barrel is physically attached to the tower through a pair of locating pins fixed on a laterally extending plate fixed to the base. The pins fit into receptacles formed on the bottom wall of the barrel and the barrel is then secured to the tower with an interlocking hasp and hasp receptacle on the two parts, then held with a padlock. The hasp is made so that the debris collection barrel has to be moved downwardly over the holding pins for assembly, and once padlocked the barrel cannot be raised, so the base pins cannot be removed from the receptacles in the barrel and the tower and barrel cannot be separated without cutting heavy metal parts.

The tower is made in two sections that permit the base section of the tower to be reached for manual attachment to a concrete support or foundation with internal bolts that cannot be loosened from the outside. A second upper section is placed on top of the lower section and is bolted thereto through the use of studs that are welded to the lower section and pass up through openings in the upper section. The vacuum motor and blower also are mounted on a plate fastened to the studs that hold the upper section in place. The upper section is short enough so that a person can reach in and tighten the bolts, and also service the motor and vacuum pump without any problems. The upper section is closed with a cover held with a drawbolt type of lock. The coin receiving and counting unit is held in the top of the tower, and the coin box for holding the coins deposited is in the upper section of the tower.

The tower can be made of stainless steel and is quite rigid because it is not the full size of the barrel needed for collecting the debris. It does not house any of the filters or the removable bag. The tower then can be made sturdy and relatively small, but is of sufficient height to house the necessary components at a location for easy access and operation.

DETAILED DESCRIPTION OF THE PREFERRED EMBODIMENTS

Figure 1:
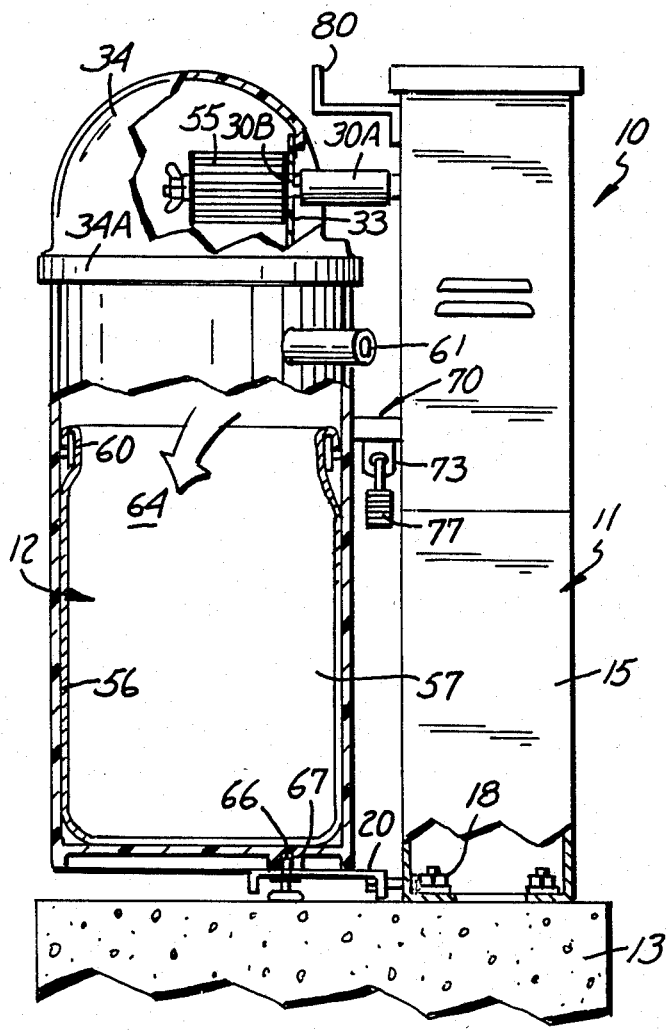
FIG. 1 is a side elevational view of a vacuum system made according to the present invention with parts in section and parts broken away.
Figure 2:
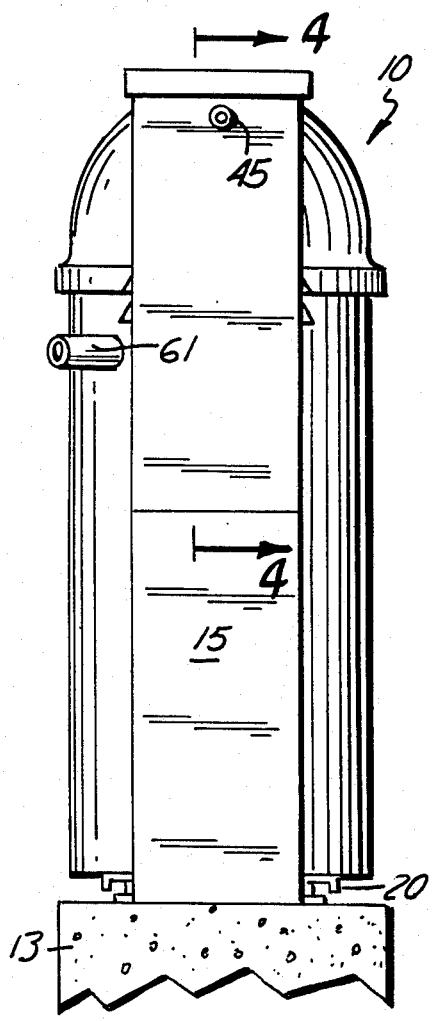
FIG. 2 is a side view thereof as viewed from the right side in FIG. 1.
Figure 3:
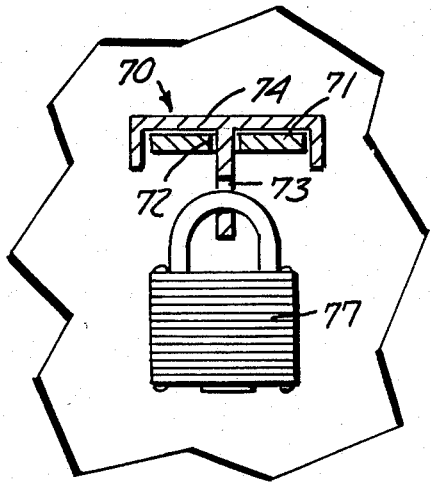
FIG. 3 is a fragmentary sectional view of a latch for connecting two components of the present invention together.

A vacuum assembly indicated generally at 10 is used for commercial, coin-operated uses, and as shown is made with two separate housings. A tower housing indicated generally at 11 forms the base for supporting a debris collection housing or barrel 12. The tower mounts onto a concrete base 13 through the use of a plurality of anchor bolts 18 (four as shown) that protrude up through corner plates welded in the corners of the lower end of the tower housing. The anchor bolts 18 are securely anchored in the concrete, and have nuts on them to hold the tower housing 11 in position. The tower housing 11 is made in two sections, including a lower section 15, and an upper section 16, which mounts on top of the lower section. In assembly, the upper section 16 is not put into place until after the lower section is securely anchored using the anchor bolts 18 that extend through the corner fastener plates which are securely fixed to the bottom of the lower section 15.

In addition, the lower section 15 has a side support plate 20 fixedly attached thereto, using suitable fasteners that are not easily cut or pried apart, to insure security. The support plate 20 is used for supporting the debris collection housing or barrel 12, as will be more fully explained.

Figure 4:
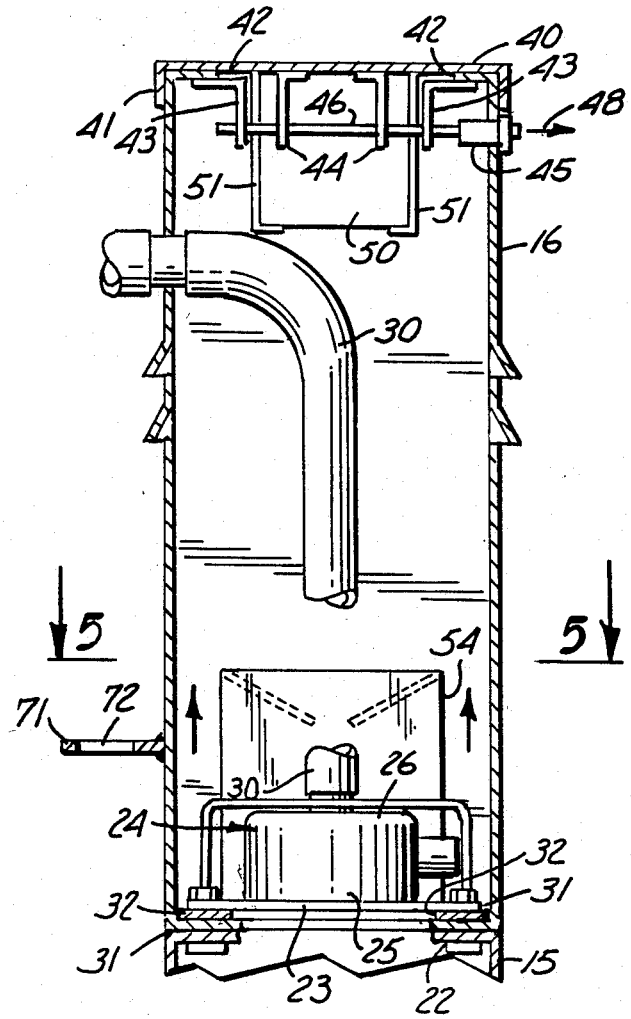
FIG. 4 is a vertical sectional view taken as on line 4—4 in FIG. 2.

As can be seen in FIG. 4 for example, the lower portion 15 has a flange at its upper end and suitable gussets or other plates can be provided for holding welded-in cap screws 22 that extend upwardly above the edge of the lower section.

Figure 5:
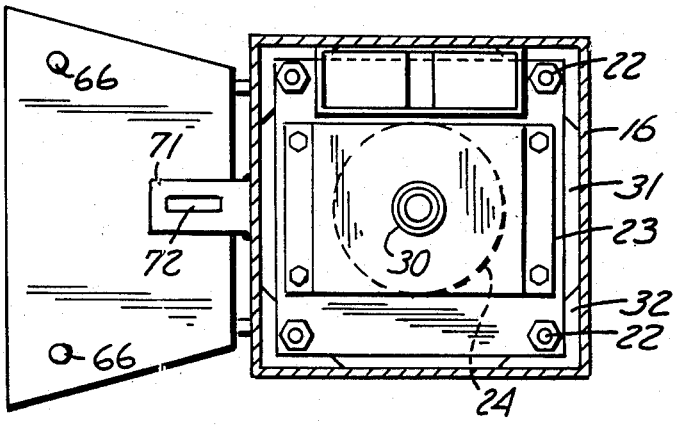
FIG. 5 is a sectional view taken as on line 5—5 in FIG. 4.

The upper section 16 has an internal flange 31 at the lower portion thereof, and also there are separate corner plates 32 at each of the four corners, that have openings therein for receiving the welded-in bolts 20 (see FIG. 5). Because the sections 15 and 16 are only half of the total height, the nuts can be placed onto the anchor bolts 18 with ease when the upper section 16 is not in place, and when upper section 16 is put in place, the nuts for fastening onto the bolts or studs 22 can be accessed from the top opening of the upper section 16. Likewise, servicing of the vacuum pump can be achieved by access through the top opening.

A plate 23 that forms a cover over the interior chamber of the section 15 is separately placed in the upper section, and as shown can be placed over the bolts 22 and held in place with suitable nuts. The plate 23 is supported on the corner plates 32 of a vacuum motor and power support plate, and it supports a vacuum providing assembly 24 which includes a motor 25 and a vacuum pump or blower 26. The vacuum assembly 24 is of size to fit within the upper section of the tower, and has an inlet hose 30 connected to the center of the blower, and the air from the blower is exhausted around the skirt or sides of the vacuum pump. The air can exit upwardly as can be seen by the arrows in FIG. 4. The upper section 16 has louvers 17 that permit air to escape from the interior chamber of the upper tower section.

The vacuum hose 30 is passed out through an opening in the side wall of the upper section 16 and has a hose section 30A which connects directly into a nipple 30B that is mounted onto a baffle wall 33 of a removable cover member 34 on the debris collection barrel or housing 12. The barrel or housing 12 is preferably a conventional fiberglass or rugged plastic unit, except it has a solid baffle wall 33, rather than an access opening with a movable cover. The baffle wall 33 provides for connection to the hose section 30A that extends out of the tower assembly 11 from the vacuum blower or pump 26.

Referring again to FIGS. 4 and 5, a tower cover member 40 has a solid top plate and a peripheral flange 41 that fits around the outside of the upper tower section 16, to form an enclosure. The upper end of the upper tower section 16 also has a turned-in peripheral flange 42 at the upper edge. The flanges 42 on opposite sides of the upper section tower have angle clips 43 mounted thereon, with depending legs that have openings therethrough that align. When the cover 40 is put into place, a pair of depending lock clips 44 affixed to the cover are positioned between the depending legs of clips 43, and lock clips 44 also have openings that align with the openings in the legs 43. A lockset 45 is positioned in one of the side walls of the upper tower section, and has an axis in alignment with the aligned openings in the legs 43 and depending clips 44. This lockset 45 is a purchased, commercially available lockset made so that it has an outer lock housing fixed to the wall of the upper tower section 16 and a threadable inner member that can be turned with a key and thereby removed from the outer lock housing. The inner member of the lockset is connected to a draw bolt 46.

The threading is done through the use of a key in a conventional manner. The threadable inner member is connected to the draw bolt 46 and the entire central portion of the lock 45 can be removed to pull the draw bolt 46 outwardly as indicated by the arrow 48 to release the cover 40. However, when the unit is to be locked, the cover 40 is put into place and the draw bolt 46 is then inserted through the openings in legs 43 and depending clips 44 so that the cover is securely held in place by the draw bolt. The inner member of lockset 45 is operated (rotated) with a key to its full seated position, and then the key is removed for security. The threaded locks of this type are conventional items, and the inner member of the lockset is adapted, as shown, to carry the elongated draw bolt for the secure locking shown.

A coin receiving, counting and power timing mechanism indicated generally at 50 is mounted in a pair of guides 51,51 that are fixed on the interior of the upper tower section 16. The coin mechanism is a conventional unit that provides for powering the motor 25 for a set length of time when the proper coin amount has been counted. The guides 51,51 are used for permitting quick removal of the coin mechanism when the cover is taken off. The coin box indicated generally at 54 is supported on the plate 23, adjacent the vacuum assembly 24, and the coin box is made so that it will catch coins dropped from the coin mechanism 50. The coin mechanism 50 of course has an exterior access slot into which coins are dropped. The coin mechanism acts as a switch and timer to provide power to the motor 25, and drive the vacuum pump to create a vacuum acting through hose 30, and into the nipple on the baffle wall 33.

The vacuum causes an air flow out of the debris collection barrel 12. The outflow is through the interior of a pleated paper filter indicated at 55 in FIG. 1, that is bolted against the baffle wall 33 in a conventional manner. Air must flow in through the outer surfaces of the filter, in order to flow out through the hose 30. The barrel cover 34 has a flange 34A that fits over the main cylinder or debris bin 56, which is the lower portion of the barrel, and provides an air seal so that air is pulled in through a nipple 61 that has a flexible hose that has an operating vacuum end on it for operators to use for vacuuming connected to it in a conventional manner. The interior of the debris bin 56 is made so that it has a peripheral support bar 60 around the outer wall, positioned below the inlet nipple 61. Support bar 60 is a conventional bar that is spaced from the wall and is made to support a debris bag 64 in the lower portions of the debris container. This bag is usually a plastic bag, and is removable when the cover 34 is removed from the debris bin. The debris bag is supported this same way in conventionally available bins that are used for garbage where the baffle wall 33 has an access opening that swings open and shut for permitting garbage to be thrown in. However, the cover 34 is sealed with the baffle wall 33 and the only place that air can exit to the hose 30 is through the filter 55. The lower wall of the bin 56 is supported and retained on the plate 20 relative to the tower. Pins 66 are fixed to the flange 20 and extend upwardly, and they will fit into receptacles 67 formed in bosses integral with the bottom wall of debris bin 56. When the container 56 is put into place on the support 20 with pins 66 inserted in receptacles 67, the support plate 20 will support the housing 12. The two housings 11 and 12 can be locked together utilizing a hasp type lock indicated generally at 70. This hasp type lock is made in two parts, one of which comprises a flange 71 that is fixed to a side wall of the upper section 16 of the tower housing 11. The flange 71 is suitably attached to the upper section 16, as by welding or some other secure means of fastening. The flange 71 has a central slot opening 72 therein that is of size to receive a tang 73 that is supported on a support plate 74 that is fixed securely to the outer side of the debris bin 56. The plate 74 can be bolted in place, or if the bin is metal, the plate 74 can be welded in place.

When the container 56 is to be placed next to the tower housing 11, it is lifted up so that the tang 73 is above the flange 71, and then the tang 73 can fit through the opening 72. As the bin 56 is lowered to place the tang 73 through slot 72, the pins 66 are fitted into the receptacles 67 at the bottom of the bin 56. As can be seen in FIG. 1, the tang 73 has a hole therethrough, into which a padlock 77 can be placed in a conventional manner to lock the two housings together. The bin 56 cannot be lifted far enough to release pins 66 from receptacles 67 when the padlock 77 is in place.

Thus, the unit is very secure because the tower housing can be made of fairly heavy stainless steel or other metal, and can easily be assembled because it is made in two sections that permit reaching in to tighten release pins 66 from receptacles 67 when the padlock 77 is in place. Welding can be used for security where necessary, and all of the bolts including the anchor bolts 18, and the bolts 22 are internal of the tower and are accessed only through the upper cover 40. The upper cover 40 can be securely locked in place.

A suitable support strap 80 can be used for mounting the external vacuum hose when it is not in use.

The device thus provides for a very sturdy assembly, easily used, easily mounted, and a high level of vacuum can be maintained while security also is maintained.

Although the present invention has been described with reference to preferred embodiments, workers skilled in the art will recognize that changes may be made in form and detail without departing from the spirit and scope of the invention.

What is claimed is:

1. A vacuum assembly comprising first and second housings;

said first housing comprising a tubular member having first and second vertically stacked sections, the first section of said tubular member being mountable on a support base having anchor bolts which extend into the first section, said second section being separable from the first section to permit placing nuts on the anchor bolts from the top of the first section;

said second section being mountable on said first section and having an open top to permit access to internal fasteners for joining the first and second sections together;

a vacuum motor and pump assembly mounted adjacent a junction between the first and second sections on the interior of the first housing and having a vacuum inlet passing through a wall of the first housing;

a lockable cover to cover the open top of said second section, whereby the first and second sections form a tower supported on anchor bolts;

means for supporting said second housing relative to the first housing, said second housing comprising an interior chamber having an air outlet leading therefrom, and said hose being connected to said air outlet;

means for connecting an inlet hose to said second housing at a level adjacent the top thereof; and a removable bag support means on the interior of said housing at a level below the inlet whereby air flow established by said vacuum motor and pump assembly causes air to flow in through the inlet of said second housing, and through the outlet to said hose, and heavy debris being deposited in a bag on said bag support means.

2. The apparatus as specified in claim 1 wherein said means for supporting comprises interfitting pins and receptacles on the first and second housings, respectively, which interfit upon relative downward movement of the second housing relative to the first housing.

3. The apparatus as specified in claim 2 and a lock for joining the midportions of said first and second housings together, said lock including first and second members on the first and second housings, respectively, said lock including means for preventing the second housing from being lifted vertically relative to the first housing to keep the interfitting pins and receptacles from separating until the lock is released.

4. The apparatus as specified in claim 1 and filter means between the interior of said second housing and said air outlet, whereby air flowing into said vacuum inlet is filtered.

5. The apparatus as specified in claim 1 and a cover member for said first housing comprising a cover that overlies the open top of said tower and has a flange that extends around the periphery thereof, and a plurality of tabs on the cover, and a plurality of tabs mounted on said upper section, said tabs each having an opening and being positioned so that they are generally parallel to each other, and the openings therein aligning in a direction transverse to the longitudinal axis of said tower, and lockable draw bolt means accessible from the exterior of said tower for providing a draw bolt to pass through the openings of the tabs and to be locked in place.

6. An exterior commercial vacuum system comprising:

a first housing forming an upright tower securely mounted to a fixed support;

a vacuum blower and motor mounted in said tower, said tower having an access opening with a lockable cover for servicing the vacuum motor and blower;

a separate debris collection housing of substantially larger size than the first housing mounted on and adjacent to the first housing, said second housing having means for supporting a disposable bag therein, and an air inlet and an air outlet, both located above the means for supporting a debris collection bag;

means for releasably locking the second housing to the first housing; and hose means coupled between the vacuum blower and the air outlet of the second housing.

7. The vacuum system of claim 6 and coin-operated means for providing power to the vacuum blower and motor for a desired length of time.

* * * * *